United States Patent [19]

Wolf et al.

[11] Patent Number: 4,730,448

[45] Date of Patent: Mar. 15, 1988

[54] TANGENTIAL-BELT DRIVE FOR WORK UNITS OF A MACHINE FOR THE PRODUCTION OF TWISTED OR TWINED YARNS

[75] Inventors: Horst Wolf, Albershausen; Ernst Halder, Ebersbach; Norbert Städele, Göppingen, all of Fed. Rep. of Germany

[73] Assignee: Zinser Textilmaschinen GmbH, Ebersbach, Fed. Rep. of Germany

[21] Appl. No.: 887,101

[22] PCT Filed: Oct. 16, 1985

[86] PCT No.: PCT/DE85/00400

§ 371 Date: Jul. 10, 1986

§ 102(e) Date: Jul. 10, 1986

[87] PCT Pub. No.: WO86/02958

PCT Pub. Date: May 22, 1986

[51] Int. Cl.[4] ..... D01H 1/241; F16G 1/14; F16H 7/02

[52] U.S. Cl. ..... 57/105; 57/100; 57/104; 474/148; 474/237

[58] Field of Search ..... 57/104, 105, 100, 92; 474/148, 237, 260–268

[56] References Cited

U.S. PATENT DOCUMENTS 4,051,656 10/1977 Burri et al. ..... 57/105
4,635,431 1/1987 Wolf ..... 57/105

FOREIGN PATENT DOCUMENTS 1066112 9/1959 Fed. Rep. of Germany ..... 57/104
1141571 1/1960 Fed. Rep. of Germany .
3301811 7/1984 Fed. Rep. of Germany .
8402932 8/1984 PCT Int'l Appl. .

*Primary Examiner*—John Petrakes
*Attorney, Agent, or Firm*—Karl F. Ross; Herbert Dubno

[57] ABSTRACT

The invention relates to a tangential-belt drive for a plurality of work units of the same kind, arranged at least in one row next to each other, of a machine for the production of twisted or twined yarns. The work units are divided into sections with at least approximately the same number of work units, each driven with an endless tangential belt. At least one electromotor is assigned to each section for driving the thereto pertaining tangential belt and guiding means for the tangential belt.

In order to reduce the energy losses of such a tangential-belt drive, the width and thickness of the tangential belt used is considerably reduced, particularly to a width between 7 and 14 mm and a thickness between 2 and 2.7 mm. Size reduction becomes possible because the number of working units in each section is selected by considering the working capacity required by this number of work units and the acceptable belt stretch factor. In further embodiments of the invention, the tangential belts of neighboring sections are guided over common guide roller elements, whose guide rollers are non-rotatably connected to each other.

6 Claims, 7 Drawing Figures

TANGENTIAL-BELT DRIVE FOR WORK UNITS OF A MACHINE FOR THE PRODUCTION OF TWISTED OR TWINED YARNS

FIELD OF THE INVENTION

The invention relates to a tangential-belt drive for a plurality of work units of the same kind, arranged next to each other in at least one row, of a machine for the production of twisted or twined yarns.

BACKGROUND OF THE INVENTION

Tangential belts of the above-described kind are used,for instance, in ring spinning machines, ring twisting machines, open-end rotor spinning machines or open-end friction spinning machines, or the like. In these machines, the work units, such as spindles, rotors, or release rollers or the like, are arranged in one or two rows and driven by tangential belts, oncoming against the whorl of the work units. It is common practice to have the drive of the tangential belt in the area of one frontal end of the machine and the guide means in the area of the other frontal end. As a result of the belt contact at the whorls and the necessary contact rollers, a considerable energy consumption and belt wear are characteristic for the plurality of the work units, due to fulling. This energy consumption and belt wear increases with the increasing number of work units, but all together also per unit, since the tangential belt has to be thicker and/or wider for transmitting the required output when the number of work units has been increased. Since the number of working units, for instance in a ring machine, can be of 1000 and more, in practice, tangential belts with a width of 35 to 38 mm and a thickness of 3 to 3.7 mm are used.

In order to reduce the load on a tangential belt running through the entire machine, it is also known (German open application No. 33 01 811) to provide at both ends of the machine at least one electromotor and to use the already provided guide disks as drive means for the tangential belt. Driven guiding disks are therefore preferably provided in each of the four guiding spots of the tangential belt . In addition, it has also become known (PCT-WO No. 84/02 932) to introduce a further drive for the tangential belt in at least one additional spot, between the ends of the machine, by means of a driven friction disk. The success of this measure, with regard to the load on the tangential belt is, however, limited.

A tangential-belt drive is also known (German published specification No. 11 41 571) wherein the work units arranged next to each other in rows, are subdivided into sections which have at least approximately the same number of work units, each driven by means of an endless tangential belt. To each of these tangential belts of a section, an electromotor and guiding means are assigned. In this type of construction, the tangential belt drives intermediate rollers, which, at their turn, drive the work units over smaller endless belts. This construction type of a tangential-belt drive has not found any practical use.

It is the object of this invention to create a tangential-belt drive of the afore-described kind, wherein losses of work capacity and/or belt loads can be reduced.

SUMMARY OF THE INVENTION

This problem is solved by selecting the number of work units of each section in accordance with the required drive capacity for this number of work units and the acceptable belt stretch factor, so that the tangential belt has a width between 7 and 15 mm and a thickness between 2 and 2.7 mm.

By using tangential belts dimensioned in this manner, the loss of working capacity is essentially reduced, so that all together a lower driving capacity is required. The load on the individual tangential belts is also correspondingly lower. Although, there is more expenditure, due to the increased number of motors, controls and supports or the like, the obtainable advantages compensate more than enough for this additional effort. Based on the reduced energy losses in the tangential belt the energy requirement is generally lowered. Further, capital costs are reduced when several small motors all having the same dimensions are used, since these motors are fabricated in greater volume than a sole motor with the same high total output.

In a further development of the invention, it is provided that the contact stretch factor of the individual tangential belts be limited from 0.6% to 1.5%. It has been proven that through this measure, the load on the belt can be kept low. Also the tolerances resulting from the belt stretching with respect to the rotational speed of the invidual work units can be kept within permissible limits.

In a further development of the invention, it is provided that the tangential belts of neighboring work units be guided over at least one common guide roller element, whose guiding rollers are or can be non-rotatably coupled to each other. This way, a certain synchronization of the speed in different sections is reached. Synchronization is advantageous especially when the drive is disconnected or out of operation due to current failure, because in this situation all the work units are phased out evenly.

In another further development of the invention, the guiding roller elements are each located between two neighboring work units. Due to this measure, no space of the spindle pitch is wasted. In order to avoid losses in transmission, it is provided that the tangential belts run directly against the whorl of the work units.

In yet another development of the invention, it is provided that the sections, in a double-row arrangement of the work units, are bordered by four guide rollers and that the thereto pertaining electromotors are arranged in the middle, between the two rows. This way, on the one hand, an available space is used for the location of the electromotors, while, on the other hand, the guide rollers can also be dimensioned by selecting their diameter in such a manner as to be arranged without modification of the machine layout, between neighboring work units. For this purpose guiding roller elements are used, each consisting of two guide rollers arranged one on top of the other in axial direction, over which the tangential belts of the neighboring sections, running correspondingly vertically displaced, are guided.

In further developing the invention, it is provided that in a twin-row arrangement of the work units, the whorls of the work units are arranged on the side of the tangential belt facing away from the longitudinal median of the work section, while the guide roller elements are located on the side of the tangential belt facing the longitudinal median. This ensures good use of the space, as well as avoids additional loads on the work units.

In a further development of the invention, it is established that the number of work units in a section should be between 80 and 150. It has been determined that within this range there can be achieved an optimal cross section of the tangential belt, as well as an optimal required output of the individual driving motors .

BRIEF DESCRIPTION OF THE DRAWING

Examples of embodiments according to the invention are described with the aid of a schematic drawing. With the assistance of these embodiments,the invention will be described and explained in more detail.

DETAILED DESCRIPTION OF THE INVENTION

Figure 1:
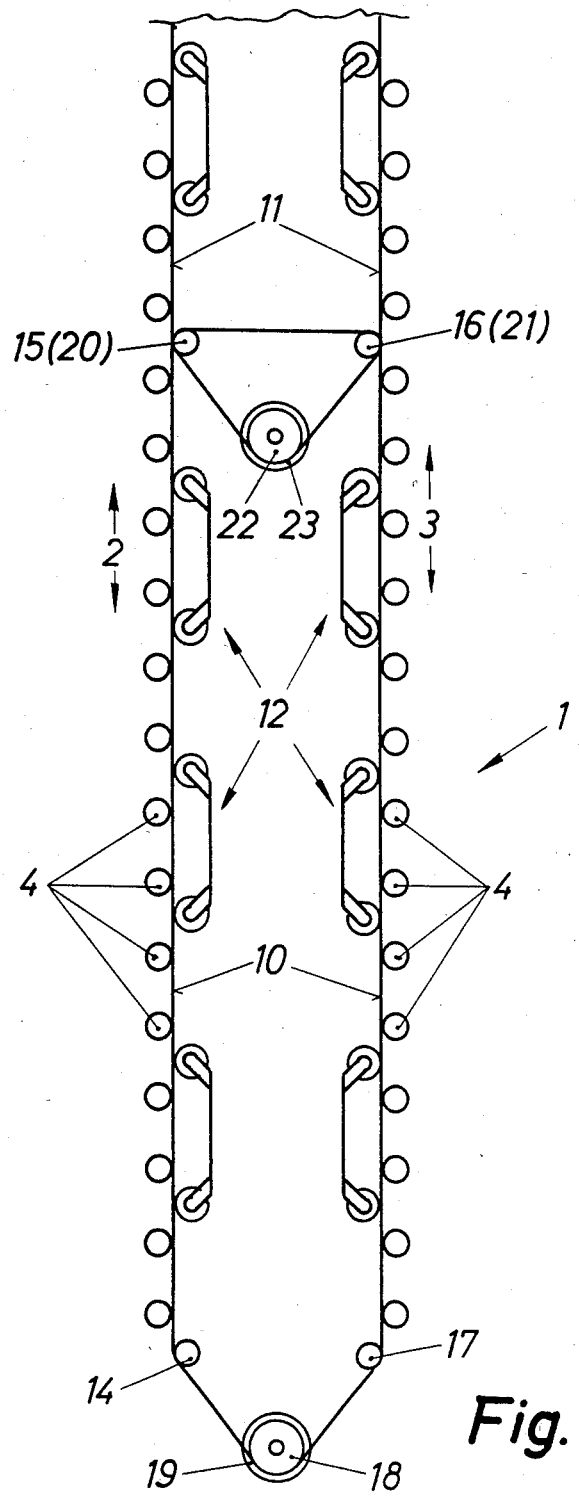
FIG. 1 shows a partial view of a machine with two parallel rows of work units of the same kind.

In the first embodiment example according to FIG. 1, the machine, marked as a whole with the numeral 1, presents two parallel rows 2 and 3, driven commonly with the same rotational speed and consisting of the same work units 4. These work units 4 can, for instance, be spindles, whereby FIG. 1 can be understood as a top view of the spindle area of a ring spinning machine. According to FIG. 4 each spindle 4 is supported in a spindle bearing 5, which is fastened by means of a nut 6 to the spindle rail 7, running along each respective side of the machine. Each spindle 4 has a whorl 8, through which it is driven by a tangential belt 10, 16 respectively. Similarly constructed suspended pressure rollers 12 serve for maintaining the contact of the tangential belts 10, 11 against the whorl 8.

In FIG. 1, the whorls 8 of a first group of fourteen work units 4 in each row 2 and 3 are driven by a first endless tangential belt 10 and each further group of twelve work units 4 in both rows 2 and 3 is driven by further tangential belts 11 and so forth. The tangential belt 10 is guided through the guide rollers 14, 15, 16, and 17 and winds around the drive roller 18 of the electromotor 19. The tangential belt 11 is guided through the guide rollers 20 and 21, co-axial to the guide rollers 15, 16, and through further guide rollers, not visible in the drawing and winds around the drive roller 22 of an electromotor 23. As can be seen from FIGS. 6 and 7, neighboring tangential belts are each vertically offset with regard to each other.

Figure 4:
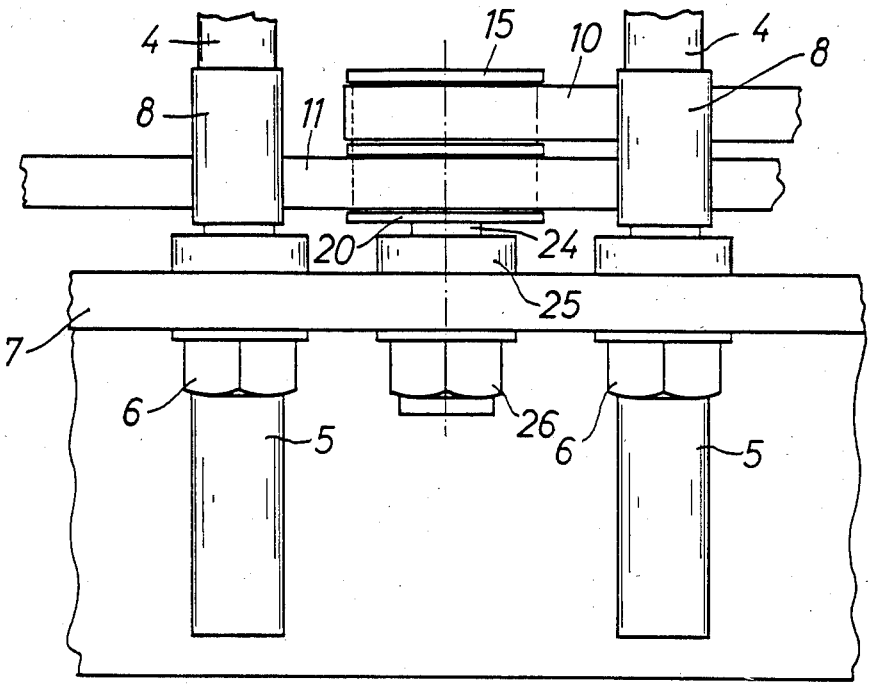
FIG. 4 shows a lateral view of a guiding roller element and of two work units consisting of spindles.
Figure 5:
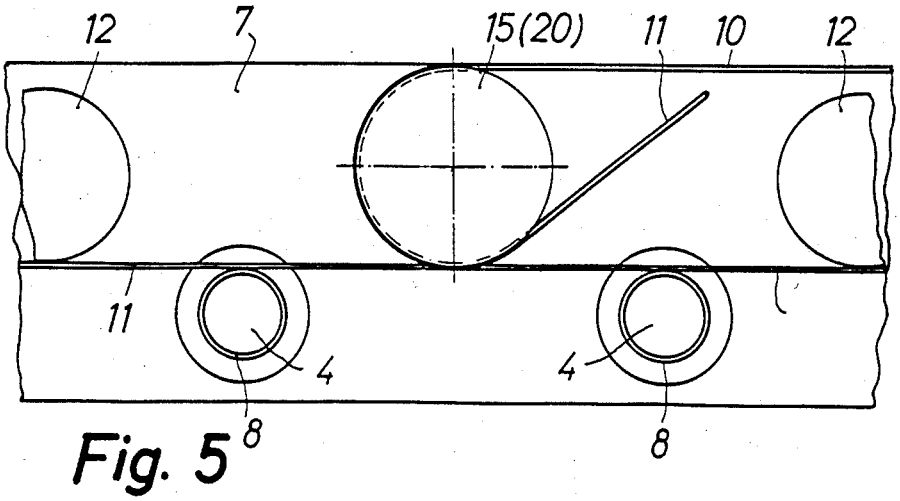
FIG. 5 shows a top view of the machine part represented in FIG. 4.

FIG. 1 shows in the ring spinning machine 1 only the tangential belt 10 and a part of the second tangential belt 11. However, a broken line indicates that the machine is actually longer, whereby along the machine considerably more work units can be mounted and a greater number of tangential belts can be present. For the sake of a simple representation, only 28 driven work units are shown for each tangential belt. In practice, depending from the energy requirement of a spindle, each tangential belt drives between 80 and 150 spindles, so that in a ring spinning machine with, for instance, 1000 spindles, between 12 and 7 tangential belts can be mounted. Further, in accordance with the invention, the guiding rollers of neighboring tangential belts are non-rotatably connected to each other and form a guide roller element. For instance, FIG. 4 shows that the guide rollers 15 and 20 are mounted on a common shaft 24. The same stands for the guide rollers 16 and 21. The shafts 24 of the guide rollers are rotatably supported in bearings 25, which are connected to the spindle rail 7 by nuts 26.

Figure 2:
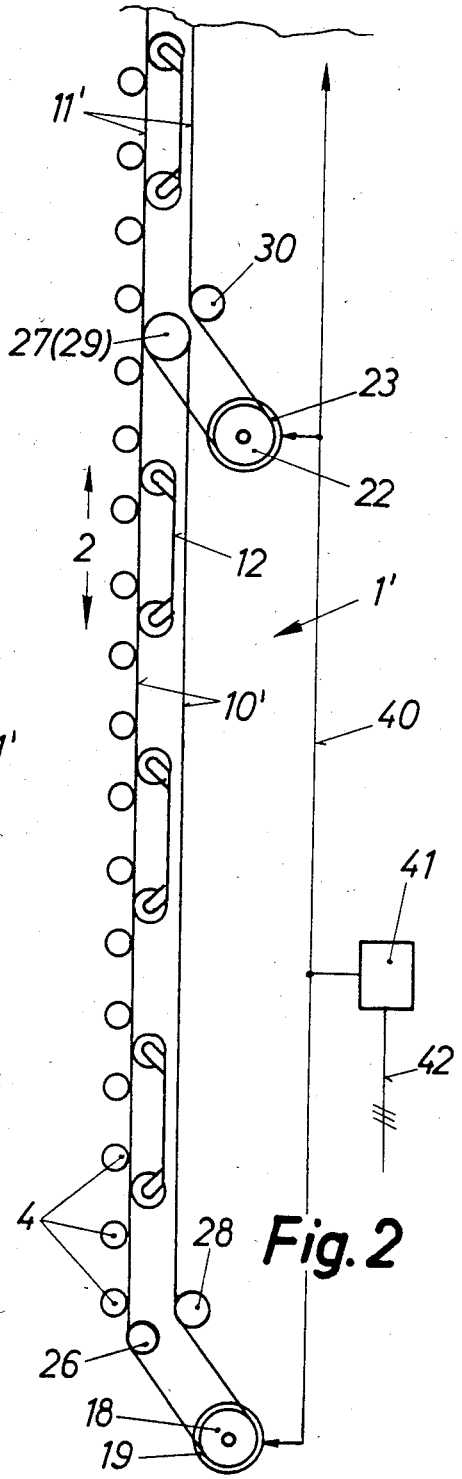
FIG. 2 shows a partial view of a machine with a single row of work units of the same kind.

FIG. 2 shows a machine 1' with only one row 2 of work units 4. These can be the spindles of a one-sided spinning frame or the drive of the rotors of one side of an open-end spinning frame. Here also a first group of fourteen work units 4 of the only row 2 is driven by a first tangential belt 10'; a second group of fourteen work units 4 (partially shown) is driven by a second tangential belt 11'. Further tangential belts can drive further groups of work units. The tangential belts are actuatable by the electromotors 19, 23, on each of whose shafts a drive roller 18, 22, respectively, is supported, the pertaining tangential belts 10', 11', respectively, winding thereabout.

Each tangential belt 10', 11' runs over three guide rollers 26, 27, 28, or 29, 30 ( the third one is not visible any more), respectively, whereby here too the guide rollers 27 and 29 arranged one above the other are non-rotatably connected to each other and form the guide roller element common to both neighboring tangential belts 10' and 11'.

The machine 1" of the third embodiment, represented in FIG. 3, has again two rows 2 and 3 of work units 4. Groups of twelve and fourteen work units of rows 2 and 3, respectively are driven by tangential belts 10" and 33, respectively.

This embodiment corresponds to nearly a doubling of the embodiment of FIG. 2. Thus, each one of the two rows of work units is driven independently from the other one.

For instance, one row of work units can stand still, while the other one is running—this occurs when the work units are spindles of a ring spinning machine with independently driven sides. Also, for instance, one row of work units can be driven with a rotational speed which is different from the one of the other row—this for example occurs when the work units in one row are rotors and the work units in the other row are release rollers of an open-end spinning machine. The motor 19, via its driving disk 18, drives here the tangential belt 10", which is guided over the guide rollers 26, 27, 28, and drives one group of work units 4 of the row 2. A second motor 23 drives over its driving disk 22 the next tangential belt 11", which is wound around the guide roller 29, located underneath the guide roller 27 and non-rotatably connected thereto, around a guide roller not shown here and which corresponds to the guide roller 27 of the first tangential belt 10" and around the guide roller 30. Further tangential belts are arranged and guided correspondingly.

The row 3 of the work units shows the extremity of such a row: a last drive motor 31 drives via its disk 32 the last tangential belt 33 of this row, which is also guided over three guide rollers 34, 35, 36. The guide roller 34 is again a part of a guide roller element, common to the tangential belt 33 and the neighboring tangential belt 37.

Due to the fact that only approximately 80 to 150 spindles are driven by one tangential belt, the tangential belts can be considerably thinner and narrower as is the case with a tangential belt which drives all the work units of a machine or all the work units of a row.

The tangential belt can have a width between 7 and 14 mm and a thickness between 2 and 2.7 mm. A cross section between 14 and 38 $mm^2$ results, respectively a reduction of the cross section by 15–30% compared to the heretofore used belts.

The contact stretch factor, measured when the machine is not in operation, should be as low as possible in this case and lie between 0.6 and 1.5%. The tangential belt can be made of polyamide, polyester or compounds based upon polyamide-, polyester, as for instance in the case of the material known under the commercial name of "Kevlar" which is an aramid fiber sold by E. I. DuPont de Nemours, Corp., Wilmington, Del. When the tangential belt is made of polyester, the contact stretch factor is between 1 and 1.5%. In a compound of the aforementioned kind, the contact stretch factor lies between 0.3 and 1%.

Figure 6:
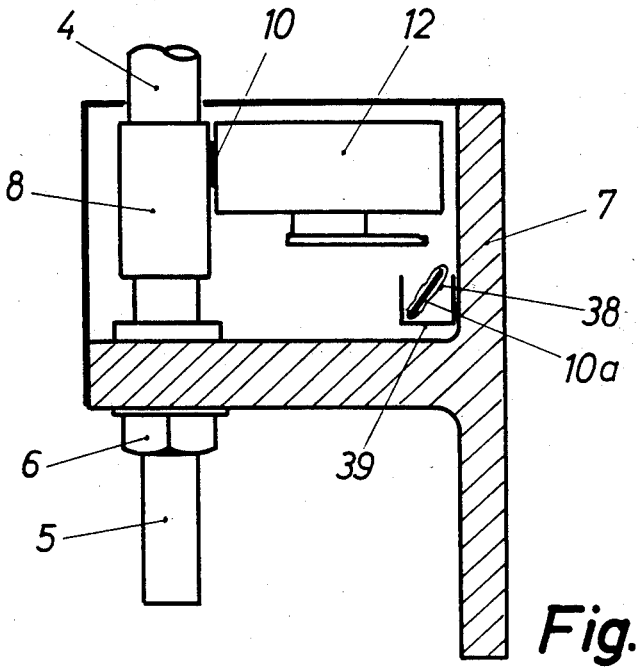
FIGS. 6 and 7 show cross sections through the spindle rail of a ring spinning machine.
Figure 7:
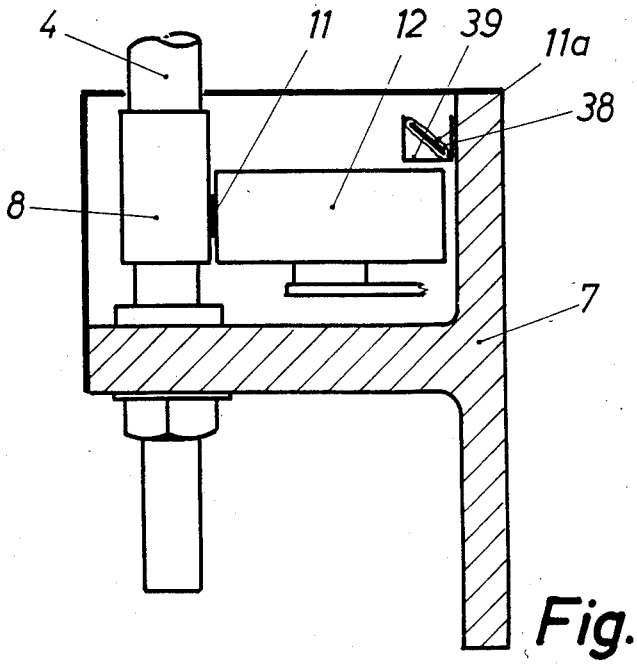

As a result of the small dimensions of these tangential belts, as shown in FIGS. 6 and 7, along the path of a tangential belt at least one further tangential belt 10, 11, respectively , of the same kind can be accommodated in the machine as a spare, preferably in the spindle rail 7. This spare belt can be surrounded by a protective plastic casing 38 and mounted in a support 39, which is fastened inside the spindle rail 7. If the tangential belt is damaged, this tangential belt can be taken out from the plastic casing without serious delays and be put into operation. Corresponding to the vertical offsetting of the neighboring tangential belts, this support 39 can be mounted either over the suspended pressure rollers 12 (FIG. 7) or under it ( FIG. 6).

Electromotors which drive tangential belts having common guide elements and, as a result, synchronized runs, have also a common source of current. The electromotors are three-phased motors, which are supplied with three-phase current from the rotational speed control device, over a conduit. In the embodiment of FIG. 2, all the belt drive motors 19, 23, . . . of the spinning frame are connected in parallel to a conduit 40, which is connected to the network 42 over the control device 41. The control device 41 allows that all connected motors be connected or disconnected together. It can also have means for the modification of the rotational speed of the motors, for instance by modifying the current frequency.

Figure 3:
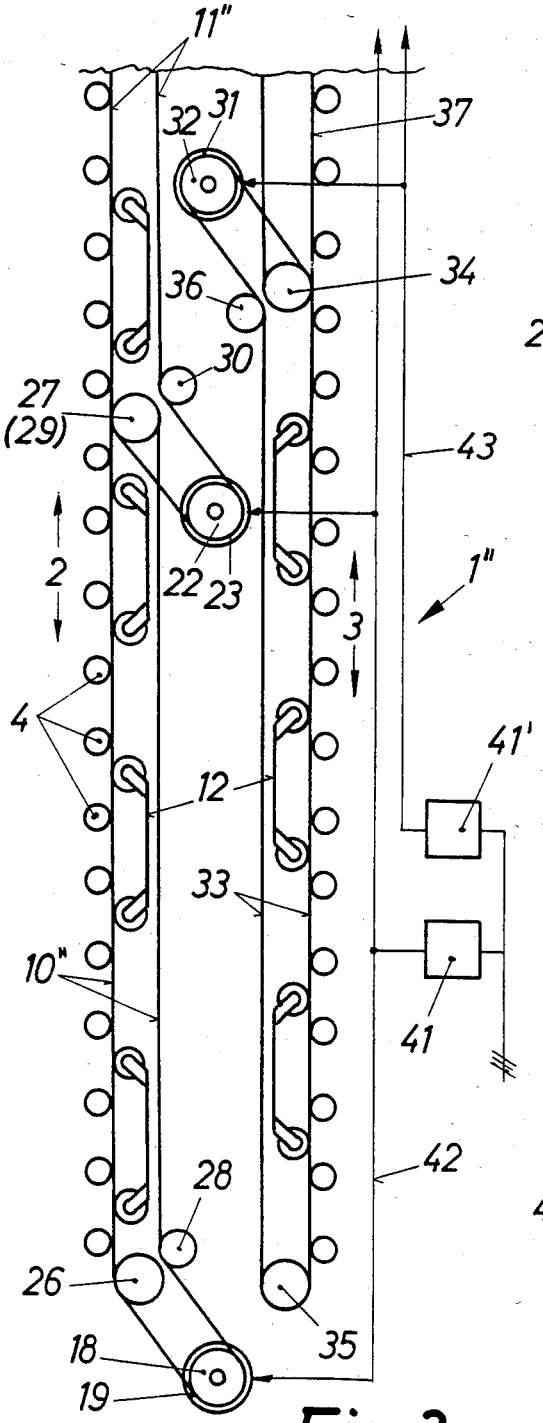
FIG. 3 shows a partial view of a machine with two parallel rows of work units of the same kind, or of work units of the same kind in each of the rows.

In the embodiment of FIG. 3 it is assumed that the work units 4 of both rows 2 and 3 should be independently actuatable. For this purpose, two control units 41 and 41', which can be actuated independently from each other, are provided, and the control device 41 controls over the conduit 42 the motors 19, 23, . . . . which drive the tangential belts 10'' and 11'' and through these the work units 4 of the row 2. Over the conduit 43, the control device 41' supplies the motors 31, . . . , which drive the tangential belts 37, 33, . . . , which in turn drive the work units 4 of the row 3. In the case where all the work units are to be uniformly driven, only one control unit is required, to which all motors have to be connected.

We claim:

1. A tangential-belt drive for a machine used in the production of twisted or twined yarns comprising:

a plurality of work units of the same kind, arranged next to each other in at least one row, the work units being subdivided in a plurality of sections with at least approximately the same number of work units, and said number allowing an acceptable belt stretch factor;

an endless tangential belt driving each of said sections, each of said tangential belts having a belt stretch factor between 0.6 and 1.5%, a width between 7 and 15 mm and a thickness between 2 and 2.7 mm;

at least one electromotor for driving the tangential belt pertaining to each section; and guide means assigned to the tangential belt.

2. Tangential-belt drive according to claim 1, characterized by that the guide means are guide roller elements and these elements are arranged each between two neighboring sections of work units .

3. Tangential-belt drive according to claim 1, characterized by that the tangential belts are run directly against at least one whorl attached to said work units.

4. Tangential-belt drive according to claim 1 , characterized by that the electromotors of all sections are connected to a common rotational-speed control.

5. Tangential-belt drive according to claim 1, characterized by that in a twin row arrangement of the work units, the sections are bordered by four guide rollers and that the thereto assigned electromotors are arranged at least approximately in the middle, between the two rows.

6. Tangential-belt drive according to claim 1, characterized by that in a twin row arrangement of the work units at least one whorl is attached to work units arranged on the side of the tangential belts facing away from a longitudinal median of the section and the guide means comprising guide roller elements are arranged on a side of the tangential belts facing the longitudinal median of the sections.

* * * * *